US008111121B2

(12) United States Patent
Hamelinck et al.

(10) Patent No.: US 8,111,121 B2
(45) Date of Patent: Feb. 7, 2012

(54) ACTUATOR

(75) Inventors: Roger Franciscus Mattheus Maria Hamelinck, Dongen (NL); Petrus Carolus Johannes Nicolaas Rosielle, Veldhoven (NL)

(73) Assignee: Technische Universiteit Eindhoven, Eindhoven (NL)

( * ) Notice: Subject to any disclaimer, the term of this patent is extended or adjusted under 35 U.S.C. 154(b) by 509 days.

(21) Appl. No.: 11/995,468

(22) PCT Filed: Jul. 12, 2006

(86) PCT No.: PCT/NL2006/000360

§ 371 (c)(1),
(2), (4) Date: Jun. 12, 2008

(87) PCT Pub. No.: WO2007/008068

PCT Pub. Date: Jan. 18, 2007

(65) Prior Publication Data

US 2008/0252403 A1 Oct. 16, 2008

(30) Foreign Application Priority Data

Jul. 13, 2005 (NL) ..... 1029504

(51) Int. Cl.
*H01F 7/00* (2006.01)

(52) U.S. Cl. ..... 335/229; 335/230

(58) Field of Classification Search ..... 335/229, 335/230

See application file for complete search history.

(56) References Cited

U.S. PATENT DOCUMENTS

| | | | | |
|---|---|---|---|---|
| 4,538,129 | A * | 8/1985 | Fisher | 335/230 |
| 4,649,359 | A * | 3/1987 | Doki et al. | 335/222 |
| 4,835,503 | A | 5/1989 | Everett | |
| 5,202,658 | A * | 4/1993 | Everett et al. | 335/230 |
| 5,475,353 | A * | 12/1995 | Roshen et al. | 335/78 |
| 5,809,157 | A * | 9/1998 | Grumazescu | 381/412 |
| 5,921,382 | A * | 7/1999 | Retter | 200/514 |
| 6,281,772 | B1 * | 8/2001 | Adams | 335/277 |
| 6,336,621 | B1 * | 1/2002 | Ii et al. | 251/129.15 |
| 6,633,212 | B1 * | 10/2003 | Ruan et al. | 335/78 |
| 6,889,565 | B2 * | 5/2005 | DeConde et al. | 73/862.042 |

FOREIGN PATENT DOCUMENTS

EP 0 736 882 A1 10/1996

* cited by examiner

*Primary Examiner* — Elvin G Enad
*Assistant Examiner* — Alexander Talpalatskiy
(74) *Attorney, Agent, or Firm* — Finnegan, Henderson, Farabow, Garrett & Dunner, L.L.P.

(57) ABSTRACT

The invention relates to an actuator comprising a leaf spring attached to a carrier in at least one point of attachment, means for providing a magnetic field and means for guiding the magnetic field so as to provide a magnetic flux loop. A movable part of the leaf spring is movable relative to the means for providing the magnetic field. The actuator further comprises a drive core attached to the movable part of the leaf spring, which is incorporated in the flux loop, for imparting the relative movement to the movable part. The drive core is so positioned that the magnetic properties of the flux loop are changed under the influence of said relative movement for gearing the magnetic force on the drive core and the spring force of the leaf spring to each other.

17 Claims, 4 Drawing Sheets

ACTUATOR

The present invention relates to an actuator comprising a leaf spring attached to a carrier in at least one point thereof, means for providing a magnetic field and means for guiding the magnetic field so as to provide a magnetic flux loop, wherein a movable part of the leaf spring is movable relative to the means for providing the magnetic field.

Such actuators, which are known, consist of such a leaf spring attached to a carrier, for example, with the means for providing the magnetic field consisting of a combination of one or more permanent magnets and one or more electromagnets. The magnetic force exerted on the leaf spring can be controlled by means of the electromagnets, in such a manner that a deflection is imparted to a part of or an end of the leaf spring under the influence of the magnetic forces.

A drawback of such actuators is that the magnetic force becomes dependent on the properties of the leaf spring due to magnetic saturation in the leaf spring of the actuator. This causes problems for the designer of such actuators and, in addition, makes it more difficult to control the actuator. Since the magnetic force is limited by said magnetic saturation, the extent of deflection of the leaf spring is limited by the magnetic saturation thereof.

U.S. Pat. No. 4,835,503 discloses an actuator in which a drive core is suspended by means of leaf springs, with the drive core being suspended in and forming part of a flux loop, and in which a magnetic force can be exerted on the drive core by means of the flux loop. A drawback of the actuator described therein is that because of the non-linearity of the spring force of the leaf spring in dependence on the deflection, the actuator likewise exhibits non-linear behaviour. This makes it more difficult to control the actuator with the desired degree of precision.

It is an object of the present invention to provide an actuator which does not exhibit the above drawbacks and by means of which the deflection of the spring means can be readily controlled.

In addition to that it is an object of the invention to provide an actuator which is designed such that it can be mass-produced in a simple and cost-effective manner.

The above and further objects are accomplished by the present invention by providing an actuator comprising spring means attached to a carrier in at least one point thereof, means for providing a magnetic field and means for guiding the magnetic field so as to provide a magnetic flux loop, wherein a movable part of the spring means is movable relative to the means for providing the magnetic field, further comprising a drive core attached to the movable part of the spring means, which is incorporated in the flux loop, for imparting the relative movement to the movable part, characterised in that the drive core is positioned such that, in use, the magnetic reluctance of the flux loop depends on a deflection of the spring means for gearing the magnetic force on the drive core and the spring force of the spring means to each other.

According to the invention, the drive core is positioned such that, in use, the magnetic reluctance of the flux loop depends on a deflection of the spring means. This results in a non-linear relation between the deflection of the spring means and the magnetic force that is exerted, thus making it possible to gear the magnetic force and the spring force to each other already upon designing the actuator. This makes it possible to realise an advantageous equilibrium between the two forces, thereby enabling a simple and energy-efficient control of the actuator or making said control very sensitive or, on the contrary, less sensitive, in dependence on its use.

To understand this effect more clearly, it should be realised that the spring force of the spring means as a function of the deflection thereof does not exhibit a linear relation. When the spring is fully relaxed, no deflection of the movable part of the spring means takes place. When the spring is compressed, however, the spring force will increase as a result of elongation of the material of which the spring means are made. The increase in the spring force is linear for a small deflection of the spring means, but for larger deflections it is non-linear on account of said elongation. The changeover point from linear to non-linear depends on the spring design (choice of material, shape, dimensions, etc.).

It will be apparent to those skilled in the art that when the magnetic force exerted on the drive core is similar to the spring force exerted by the spring means, in dependence on the deflection of the drive core, said deflection will be readily controllable around a point of equilibrium between the magnetic force and the spring force. The deflection of the actuator can be readily controlled in that case and is sensitive to minor changes in the magnetic field. When used as an acoustic converter, for example in a microphone, the actuator becomes very sensitive to vibrations of the spring means (under the influence of sound waves, for example).

When, in addition, the drive core is attached to the spring means and the drive core is incorporated in the magnetic flux loop, the magnetic properties of the actuator become independent of the material properties of the spring means. Such a suitable mounting of the drive core results in the leaf spring being, in essence, no longer part of the magnetic flux loop, such that magnetic saturation in the spring means no longer plays a role in the actuator according to the invention. On the other hand, special embodiments of the invention may be so designed that a (small) portion of the magnetic field lines will describe a loop through the spring means, and that saturation may occur in the spring means as a result thereof. This may for example be the case when the spring means are made of steel or another suitable material. However, since the main portion of the fields lines is guided by drive core via a loop of which the spring means do not form part, said saturation no longer plays a role of significance for an actuator according to the invention.

According to one embodiment, the magnetic force of the flux loop and the spring force of the spring means both engage the drive core so as to provide the relative movement. The drive core is kept in equilibrium in that case by the magnetic force exerted by the flux loop on the one hand and by the spring force exerted by the spring means on the other hand.

According to a preferred embodiment, the means for providing the magnetic field comprise at least one permanent magnet. The permanent magnet that provides the magnetic field exerts a permanent magnetic force on the drive core of the actuator. As a result, the drive core, which is attached to the movable part of the spring means, will already impart a deflection to the spring means under the influence of the equilibrium of forces between the spring force on the one hand and the magnetic force of the permanent magnet on the other hand.

The magnetic force will increase when the drive core is moved towards the permanent magnet. Furthermore, the magnetic force on the drive core will decrease when the drive core is moved in a direction away from the magnet. In the absence of a deflection of the spring means (defined above as the state in which the spring means are fully relaxed), however, the magnetic force exerted by the permanent magnet does not equal zero, however. An increase in the deflection of the spring means, when the drive core is moved towards the magnet, leads to an increase in the spring force of the spring means and at the same time to an increase in the magnetic force exerted on the drive core. In this regime the magnetic force will increase less rapidly than the spring force, however, as a result of which an equilibrium is obtained between the spring force and the magnetic force with a particular amount of deflection. Said deflection of the actuator will occur in the quiescent state (when no further forces are exerted on the drive core). When the drive core is moved further towards the magnet, during which movement the spring means will be deformed even more, the spring force will increase even more strongly and the spring force will become larger than the magnetic force.

Those skilled in the art will appreciate that the use of an electromagnet which, according to a preferred embodiment, forms part of the means for providing a magnetic flux loop, wherein the electromagnet is so positioned relative to the permanent magnet that the magnetic fields of the electromagnets and the permanent magnet jointly provide the magnetic force on the drive core in use, makes it possible to control the deflection of the drive core on the basis of the above-described principle in that the magnetic force can either be amplified or be attenuated so as to obtain a different point of equilibrium.

It is the magnetic force exerted by the permanent magnet as a function of the deflection of the spring means (and the drive core attached thereto) that determines inter alia the sensitivity of the deflection of the actuator. If the magnetic force of the permanent magnet as a function of the deflection of the spring is properly geared to the spring force exerted by the spring means, and the magnetic force substantially keeps pace with the spring force of the spring means, the magnetic force of the permanent magnet will only have to be adapted to a small degree by means of a magnetic field of an electromagnet around the point of equilibrium in order to cause a relatively large deflection of the spring means. This will become clear when one realises that the difference between the magnetic force and the spring force must be eliminated by the electromagnet in order to provide a specific amount of deflection. If this difference is only small whilst the deflection is relatively large, it is possible to achieve a relatively large deflection of the actuator by effecting a minor adaptation of the magnetic force by means of the electromagnet, using a small amount of Ampere windings, therefore. This is very advantageous for the actuator of the present invention.

According to a preferred embodiment, the magnetic characteristic of the actuator, in particular the dependence on the magnetic force exerted on the drive core by the permanent magnet as a function of the deflection thereof, can be influenced by changing the length of the flux loop under the influence of the movement of the spring means relative to the means for providing the magnetic field. As a result, the magnetic resistance of the loop will change, which will affect the force exerted on the drive core. The reluctance or the magnetic resistance can moreover be changed by changing the diameter of the flux loop transversely to the magnetic field, for example in one or more points thereof.

This can for example be achieved by incorporating at least one air gap in the flux loop between the drive core and the means for providing the magnetic field, the dimensions of which air gap are dependent on the position of the drive core relative to the means for providing the magnetic field. If the drive core can move away from the means for providing the flux loop, the length of the flux loop can be increased, whilst the length of the flux loop can be reduced in a similar manner by moving the drive core in the direction of the means for providing a flux loop.

The magnetic resistance can moreover be changed by changing the magnetic permeability in one or more places in the flux loop. According to one embodiment this can for example be achieved by introducing a medium 3*a* (shown in FIG. 1B) further or less far into an air gap that is incorporated in the flux loop in dependence on the deflection of the spring means. The medium has a permeability different from that of air. Furthermore, movement of the drive core relative to a medium in the flux loop can take place in such a manner that the relative permeability of the air gap can thus be changed under the influence of said movement so as to change the magnetic resistance in the flux loop.

As already described above with regard to the magnitude of the magnetic force that is exerted on the drive core by a permanent magnet as a function of the distance between said drive core and the permanent magnet, increasing or decreasing the length of the flux loop will make it clear that the magnetic force as a function of the deflection of the drive core exhibits a non-linear relation thereto. The shape of the drive core and the movement of the drive core relative to the means for providing the magnetic force determined in large measure the relation between the magnetic force exerted by the actuator on the one hand an the deflection of the drive core on the other hand. It is important, therefore, to design the actuator according to the invention such that the drive core can move relative to the means for providing the magnetic field in such a manner that said movement makes it possible to change the length of the flux loop to a larger or a lesser extent, as desired. This can be achieved by making use of the dimension of the air gap between the drive core and the means for providing the magnetic field.

According to another embodiment, the actuator comprises at least one air gap in the flux loop between the drive core and the means for providing the magnetic field, which air gap functions to enable the aforesaid relative movement, wherein a dimension of the air gap is substantially independent of the relative movement.

This embodiment is based on the perception that the drive core must be able to move completely freely with respect to the means for providing the flux loop in order to enable movement of the drive core relative to said means. Furthermore, the drive core must form part of the magnetic flux loop. In the case of the above design choices, the magnetic flux loop will comprise at least two air gaps. The shape of the magnetic flux loop, in particular the shape of the drive core and the core that is attached to the means for providing the flux loop for guiding the magnetic flux back to the magnet from the drive core, as well as the suspension of the spring means, determine the extent to which the length of the magnetic flux loop depends on changes of the drive core in relation to the means for providing the magnetic field.

In particular, designs are conceivable in which the distance to be covered by the field lines through the two air gaps (in the direction of the magnetic field) will increase when the distance from the drive core to the means for providing the magnetic field increases. With such a design, the length of the magnetic flux loop strongly depends on the distance from the drive core to the means for providing the flux loop. According to another possibility, only one of the air gaps may be incorporated in the magnetic flux loop in such a manner that the dimensions thereof (seen in the direction of the magnetic flux loop) will increase when the distance from the drive core to the means for providing the flux loop increases. The other of the two air gaps that are present has been so designed that the drive element can move "in the plane of the air gap". As a result, the distance that the magnetic field lines need to bridge across the second air gap to the core of the means for providing the flux loop will remain substantially constant when the distance from the drive core to the means for providing the magnetic field increases or decreases. In an actuator thus configured, the length of the magnetic flux loop depends less strongly on the distance from the drive element to the permanent magnet, and the relation between the magnetic force of the permanent magnet and the deflection of the drive core will exhibit a different trend.

The gearing of the spring force exerted by the spring means and the magnetic force exerted by, for example, a permanent magnet to each other can also be effected through a suitable selection of the material of which the spring means are made. The spring means may for example be made of a material selected from a group comprising iron, nickel, titanium, or alloys containing one or more of these metals, but the spring means may also be made of a plastic material.

Furthermore, also the choice of material of, for example, a permanent magnet used in the means for providing the magnetic field is important with a view to gearing the spring force and the magnetic force within the actuator to each other. The permanent magnet may for example be made of a material selected from a group comprising NdFeB, SmCo or AlNiCo.

As the magnetic properties of the actuator are preferably independent of the material properties of the spring means as much as possible, also the configuration of the spring means, which form the suspension of the drive element, is of importance. As already mentioned before, the magnetic flux loop in the actuator must be configured such that the spring means do not form part thereof, so that there can be no saturation in the spring means. Furthermore, the spring means must provide the drive element with sufficient flexibility to enable a major deflection. According to one embodiment of the invention, the spring means are attached to a carrier or base of the actuator at their ends or edges, wherein the movable part of the spring means is located between said ends or edges. The movable part of the spring means may for example be located in the centre of the spring means, between the edges thereof.

According to another embodiment, the spring means have a rotationally symmetric configuration, and the movable part of the spring means is joined to the edge of the circular spring means by means of one or more of spokes formed in the spring means. In this embodiment the spring means are so configured that "spokes" extend from the edges of the spring means towards the movable part. It is noted in this connection that the spring means are made in one piece, and that the spokes form part of the spring means, therefore. In the case of a leaf spring, for example, the leaf of the leaf spring is so configured (for example cut out) that the leaf spring is not rotationally symmetric, in which case the spokes may extend in radial direction, for example between the centre of the rotationally symmetric leaf spring (which forms the movable part) and the edges thereof (which are attached to the carrier or the base in the actuator). The spokes may also extend substantially tangentially from the edges towards the centre, for example spirally, or in substantially zigzag fashion towards the centre. In the latter case the spokes are made up of segments, which are each connected to a next segment at one end, and that in such a manner that a zigzag-like "path" towards the centre is formed.

According to one embodiment, the spring means comprise at least one leaf spring, or the spring means consist of a leaf spring.

An actuator according to the invention can readily be designed to have a layered structure. Thus a design that can readily be mass-produced is realised. In this way the actuator can be produced in a cost-effective manner, as those skilled in the art will appreciate.

According to another aspect, the invention provides a group of actuators as described above, in which said group comprises means for individually driving each of the actuators of the group.

Such a group of actuators may be used in the field of reflecting telescopes, for example, wherein control of the curvature of the plane of the telescopes requires great precision, for example, and wherein said curvature moreover requires constant adaptation so as to compensate for various optical effects, for example caused by turbulence in the atmosphere. The actuator may also be used in supporting wafers during the manufacture thereof and for converting audio signals, for example in hearing aids.

The invention will be described in more detail below on the basis of non-limitative embodiments thereof, in which description reference will be made to the appended drawings, in which.

Figure 1C:
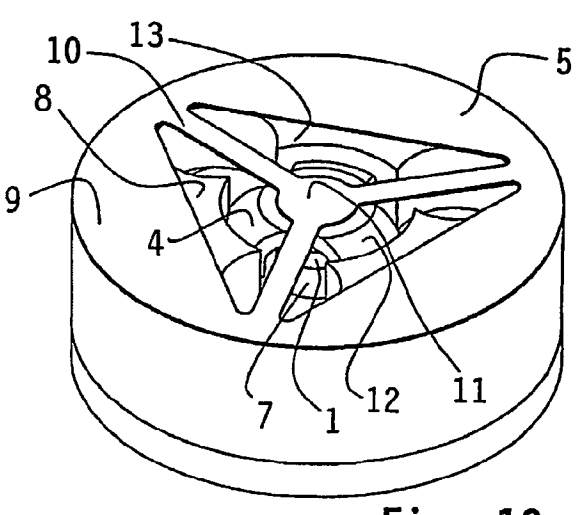
FIGS. 1A-1C are a plan view (FIG. 1A), a sectional view (FIG. 1B) and a perspective view (FIG. 1C) of a preferred embodiment of the invention.
Figure 1A:
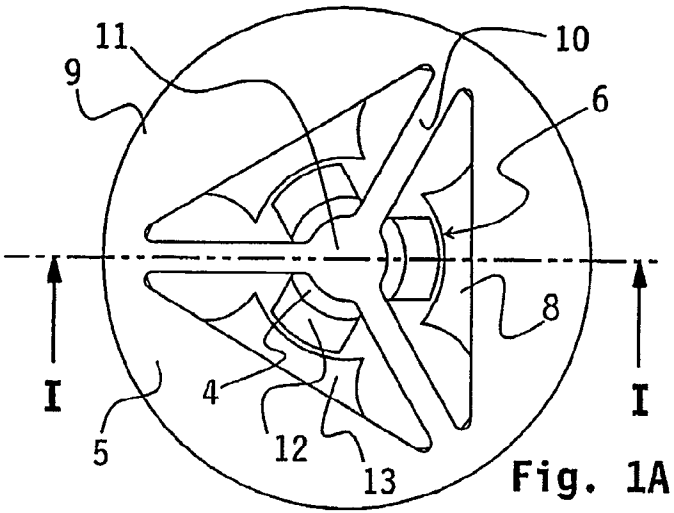
Figure 1B:
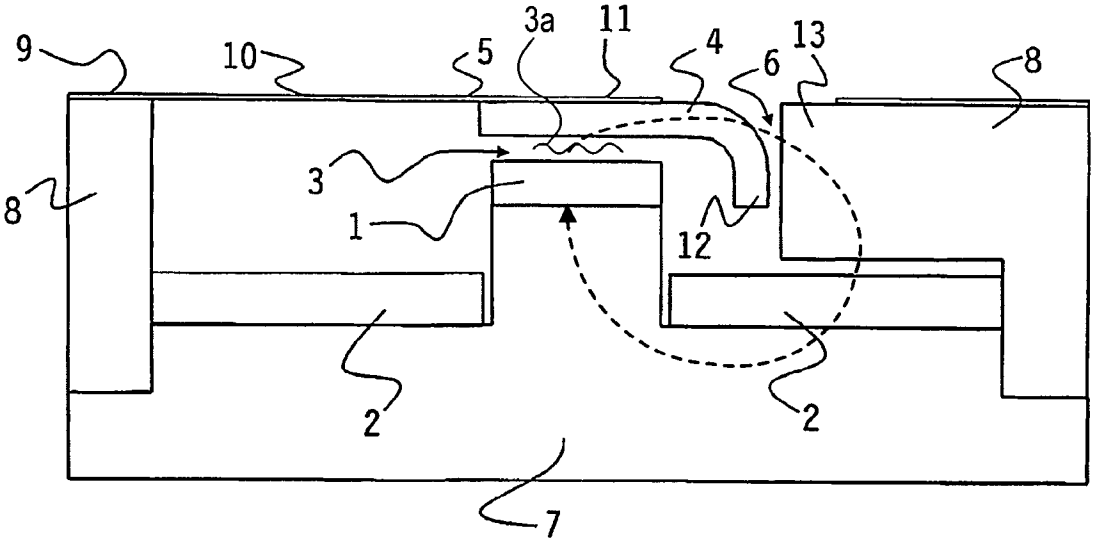

FIG. 1A is a plan view of an actuator according to the invention. FIG. 1B is a sectional view of the actuator along the line I-I. FIG. 1C is a perspective view of the actuator according to the present invention. In FIGS. 1A-1C the same numerals are used to indicate parts that are identical in each of the FIGS. 1A-1C.

The sectional view of FIG. 1B shows that a permanent magnet 1 is placed on a base 7 that is made of a material suitable for guiding the magnetic field lines. A permanent magnet 1 and a coil 2 (which forms an electromagnetic element) are placed on the base 7 in a circularly symmetric arrangement. Furthermore, a conductor core element 8 is placed on the base, which functions to conduct the magnetic field lines and which also functions as a carrier for the magnet 1 and the coil 2.

A leaf spring 5 is attached to the conductor core element or carrier 8. In the embodiment of the present invention, the actuator structure is rotationally symmetric. The rotationally symmetric leaf spring 5 therefore consists of an edge 9, three spokes 10 and a movable part 11 in the centre of the rotationally symmetric leaf spring 5. Although three spokes are used in the present embodiment, embodiments comprising more or fewer spokes are also possible. Thus, the leaf spring may be configured with only one spoke, two spokes, four spokes, five spokes, six spokes, seven spokes, etc. Those skilled in the art will appreciate that if more than three spokes or fewer than three spokes are used, the underlying structure of the actuator will have to be adapted as well. In the present embodiment, the drive core 4 that is attached to the movable part 11 of the leaf spring 5 also has a rotationally symmetric structure comprising three shoes (such as the shoe 12). The same obtains for the underlying rotationally symmetric structure of the actuator, such as the conductor core 8. The base 7, the coil 2 and the permanent magnet 1 are rotationally symmetric and need not be adapted if a different number of spokes of the leaf spring 5 is used.

As described above, the drive core 4 is suspended from the leaf spring 5 by attachment thereof to the movable central part 11. An air gap 3 is present between the drive core 4 and the permanent magnet, which air gap enables deflection of the drive core in upward and downward direction. A second air gap 6 is present between the shoe 12 of the drive core 4 and an inwardly extending part 13 of the conductor core. The shoe 12 of the drive core 4 is bent through an angle of about 90° with respect to the plane of the leaf spring so as to provide a maximum surface opposite the inwardly extending part 13 of the conductor core 8. Those skilled in the art will appreciate that the area of the surface is inversely proportional to the magnitude of the magnetic resistance of the air gap 6. It is also possible to use a different configuration of the bent shoe 12 of the drive core 4 that is shown in the figure in order to obtain the technical effect thereof. The drive core 4 may be configured as a disc (not shown), for example, which is disposed opposite the inwardly extending part 13 of the conductor core 8.

The permanent magnet 1 provides a permanent magnetic field whose field lines travel in a loop formed by the air gap 3, the drive core 4, the air gap 6, the conductor core 8, the base 7 and back to the permanent magnet 1, as shown in FIG. 1B. The field strength of the magnetic field can be increased or decreased by means of an electromagnet 2, which provides a magnetic field parallel to the magnetic field of the permanent magnet 1. The magnetic field lines of the electromagnet 2 travel in the same loop as the magnetic field lines of the magnetic field that is provided by the permanent magnet 1.

The magnetic field provided by the permanent magnet 1, whether or not supplemented with the field of the electromagnet 2, exerts a magnetic force on the drive core 4. The latter will be attracted by the magnet. The leaf spring 5 exerts a spring force of opposite sense on the drive core 4, however, such that an equilibrium of forces is created between the magnetic force on the one hand and the spring force on the drive core on the other hand. In the quiescent state, when only the permanent magnet 1 and the leaf spring 5 exert a force on the drive core 4, the drive core will exhibit a degree of deflection that matches the equilibrium of forces. The magnetic force on the drive core 4 can be varied by enlarging or reducing the magnetic field by means of the electromagnet 2, so that the drive core 4 can move the leaf spring 5 upwards and downwards.

Figure 2:
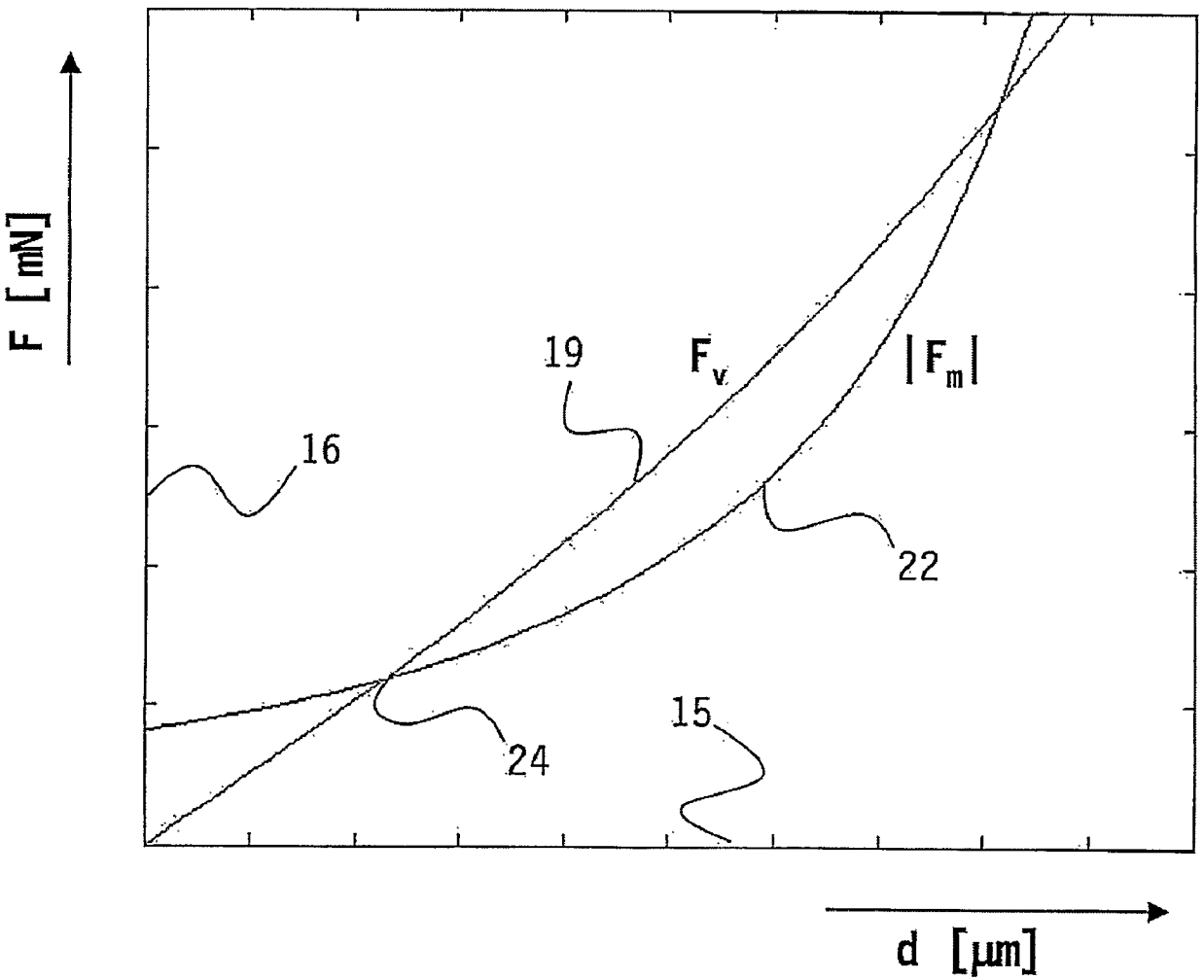
FIG. 2 shows the trend of the spring force and the magnetic force on the permanent magnet as a function of the deflection.

Reference is made to FIG. 2 for a description of the operation of the equilibrium of forces on the drive core 4, in which figure the magnitude of both the spring force and the magnetic force is plotted against the deflection of the leaf spring. Plotted on the horizontal axis 15 is the deflection of the leaf spring. A deflection of O μm is achieved when the leaf spring is fully relaxed, i.e. when no magnetic force or other force is being exerted on the drive core. Plotted on the vertical axis 16 is the magnitude of the forces.

The extent of deflection of the drive core 4 that can be achieved depends on the dimensions of the actuator. In a laboratory set-up, deflections of a few hundred microns (μm) and forces of a few hundred milinewton (mN) were obtained with an actuator having a diameter of 6 mm and a permanent magnet having diameter of 1 mm and a thickness of 0.25 mm.

The spring force is represented by the curve 19, which is substantially linear in FIG. 2. Such a linear relation obtains for small deflections of the leaf spring. In actual fact, the relation between the deflection of the leaf spring and the spring force is not linear in the case of large deflections, with the spring force becoming larger and larger as the amount of deflection increases. The changeover point from linear to nonlinear depends inter alia on the thickness of the leaf spring, the kind of material and the shape of the leaf spring (or the shape of the spokes). The curve 22 represents the magnitude of the magnetic force exerted by the permanent magnet in the embodiment that is shown in FIG. 1. It is noted in this connection that the magnetic force is of opposite sense to the spring force, and that in FIG. 2 the absolute value of the magnetic force is plotted against the spring force, such that the curves 19 and 22 intersect.

From the trend of the magnetic force it is evident that when the drive element is positioned closer to the permanent magnet, the magnetic force on the drive core increases further and further, resulting in a non-linear relation 22. In the case of zero deflection of the leaf spring, with the leaf spring being fully relaxed, the permanent magnet still exerts a force on the drive core, however, since it is positioned near the permanent magnet. When the electromagnet is not activated, the drive core will deflect to an extent that matches the equilibrium point 24, when the spring force equals the magnetic force. The deflection of the drive core around the equilibrium point 24 can be varied by varying the magnetic force on the drive core by means of the electromagnet.

The energy required for controlling the deflection of the drive element, and the ease with which this can take place, depends in large measure on the shape of the curves 19 and 22 that are shown in FIG. 2, which represent the trend of the magnetic force and the trend of the spring force as a function of the deflection of the spring. If the characteristic of the magnetic force as represented by the curve 22 is geared to the characteristic of the spring force as represented by the curve 19, it will be much easier to gear the control of the deflection of the drive core to the use of the actuator. Thus it is possible to change the deflection of the drive core 4, if desired, using only a small number of ampere windings (the product of current through the electromagnet 2 and the number of windings of the electromagnet 2) in the electromagnet 2, by gearing the curves 22 and 19 such that they exhibit substantially the same degree of flatness around the equilibrium point. To that end, the trend of the magnetic force as a function of the deflection must preferably be flatter in the illustrated example. It is noted in this connection that when the magnetic curve exhibits nearly the same degree of flatness as the spring force curve, a small change in the number of ampere windings of the electromagnet may result in a relatively large deflection of the actuator. If the actuator is used as an acoustic converter, for example for a sensitive microphone, such behaviour may provide advantages. Consequently, the trend of the magnetic curve must be advantageously geared to that of the spring force curve in dependence on the intended use of the actuator. The actuator according to the present invention makes it possible to gear the two curves 19 and 22 precisely to each other. (It is noted that terms such as "steeper" and "flatter" as used in the foregoing and below should be read within the context of FIG. 2, in which the trend of the forces (curves 19 and 22) is plotted against the deflection of a drive core (such as the drive core 4) along linear axes.)

As already noted before, the trend of the curve 22 in FIG. 2 depends on the flux loop in which the magnetic lines travel. The air gap 3 forms a variable magnetic resistance, which increases as the dimension of the air gap 3 increases, and which decreases when the drive core 4 is positioned closer to the permanent magnet 1 and consequently the dimension of the air gap 3 decreases. The magnetic resistances formed by the drive core 4, the air gap 6, a conductor core 8 and the base 7 do not depend on the extent of deflection of the drive core 4. It is in particular noted in this connection that since the drive core 4 is bent, as a result of which it blends with the shoe 12, which shoe has a lateral surface adjacent to the air gap 6 and parallel to the lateral surface of the conductor core 8, the air gap to be bridged by the magnetic field lines will remain largely unchanged in the case of changes in the deflection of the drive core 4. Consequently, the varying dimension of the air gap 3, which air gap forms a magnetic resistance that depends on the extent of the deflection of the drive core 4, is the reason why the magnetic force exerted on the drive core by the permanent magnet becomes non-linearly dependent on the deflection of the drive core 4. An increase in the dimension of the air gap 3 causes the total length of the flux loop in which the field lines must travel, in particular the distance across the air gap to be bridged, to increase. A change in the length of the flux loop causes the magnetic resistance in certain parts of the flux loop to increase as well, and the magnetic force on the drive core as a function of the deflection exhibits the typical trend that is represented by the curve 22 in FIG. 2.

The characteristic of the curve 22 can be changed in a simple manner by making one or more of the following modifications in the design: changing the dimensions of the permanent magnet 1, changing the distance from the magnet 1 to the drive core 4, changing the shape of the drive core 4 in relation to the shape of the conductor core 8 (for example in order that also the magnetic resistance of the air gap 6 becomes slightly dependent on the deflection of the drive core and 4), the choice of material of the permanent magnet 1, the choice of material of the drive core 4, the choice of material of the base 7 or the conductor core 8. It is noted in this regard that since the flux loop in which the field lines must travel does not include the leaf spring 5, and consequently the leaf spring 5 does not form part of the flux loop, the magnetic force as a function of the deflection is independent of the material properties of the leaf spring. This makes it easier to gear the trend of the magnetic force as a function of the deflection of the drive core to the spring force as a function of the deflection of the drive core 4.

The trend of the spring force of the leaf spring 5 as a function of the deflection of the drive core 4 can be changed by making the following modifications in the design: changing the shape of the leaf spring 5 (for example by increasing or decreasing the number of the spokes 10 from which the movable central part 11 is suspended), the choice of the material from which the leaf spring 5 is made, changing the thickness of the leaf spring, changing the width of the spokes, etc.

It is noted in this connection that the leaf spring 5 is rotationally symmetric in the embodiment that is shown in FIG. 1, comprising three spokes 10 from the centre 11 to the edges 9. Said spokes 10, which extend radially towards the edges, may be substituted for spokes that extend substantially tangentially, for example spirally towards the centre. The advantage of this is that the length of the spokes is much greater, and consequently the spring force as a function of the deflection will exhibit a flatter trend. To prevent strong rotation of the central part 11 in the case of a large deflection of the actuator in such an embodiment, it may be decided to use spokes 10 that extend in zigzag fashion towards the centre, each spoke 10 consisting of interconnected parts that each extend tangentially relative to the rotational symmetry.

Figure 3:
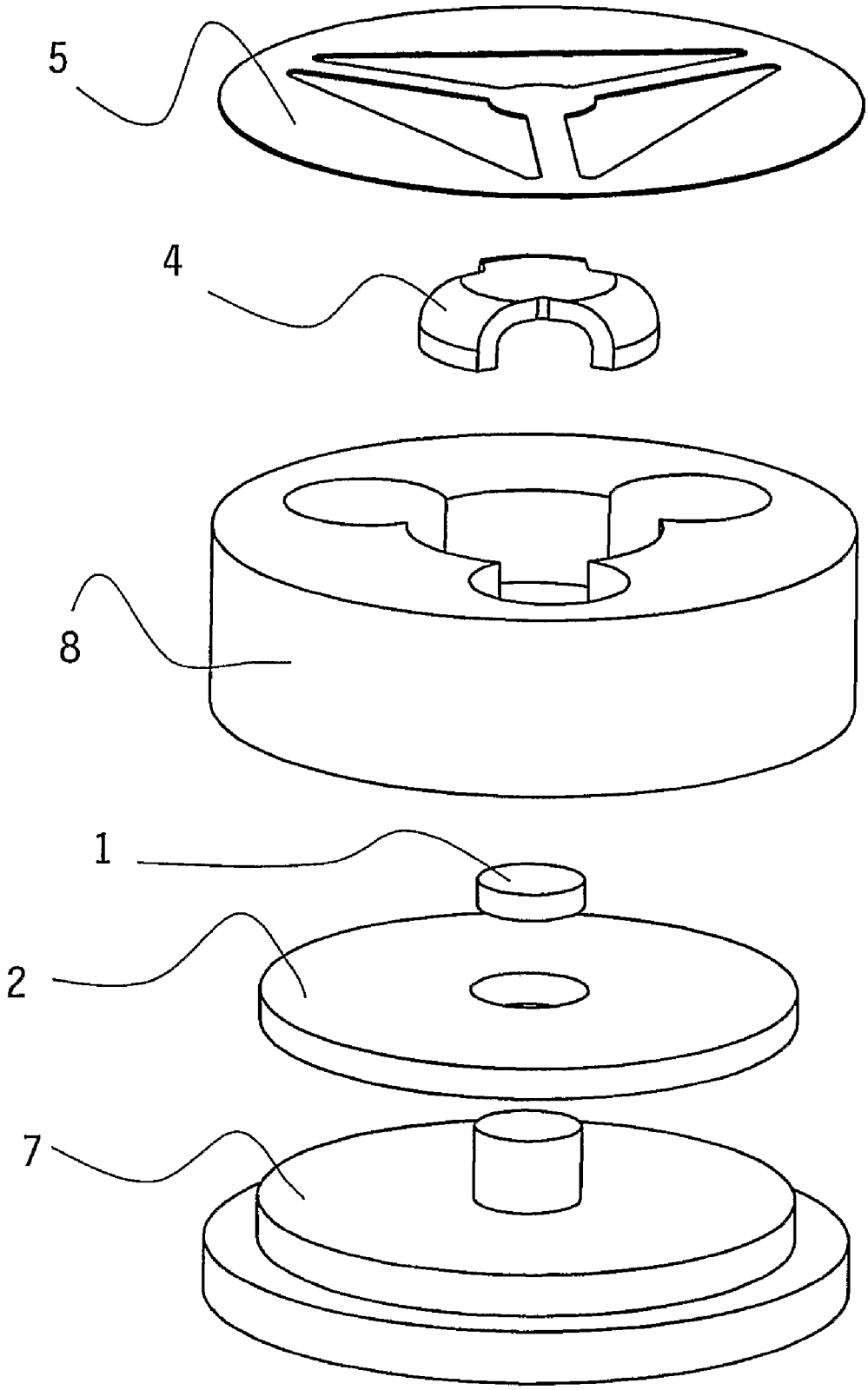
FIG. 3 shows the layered structure of an embodiment of the actuator according to the invention.

FIG. 3 is an exploded view of an embodiment of the invention in which the layered structure of the actuator according to the invention is clearly shown. An actuator according to this embodiment of the invention is very easy to manufacture, as each of the components can be separately produced in a simple manner, which components are subsequently placed one on top of another in a layered structure. As FIG. 3 shows, the electromagnet 2 and the permanent magnet 1 are placed on the base 7, after which the conductor core 8 can be arranged thereover and be attached to the base 7. Then the leaf spring 5 and the drive core are connected together and the assembly of leaf spring 5 and drive core 4 is placed on the conductor core 8. Such a structure of the actuator is highly suitable for being machine-manufactured.

Figure 4B:
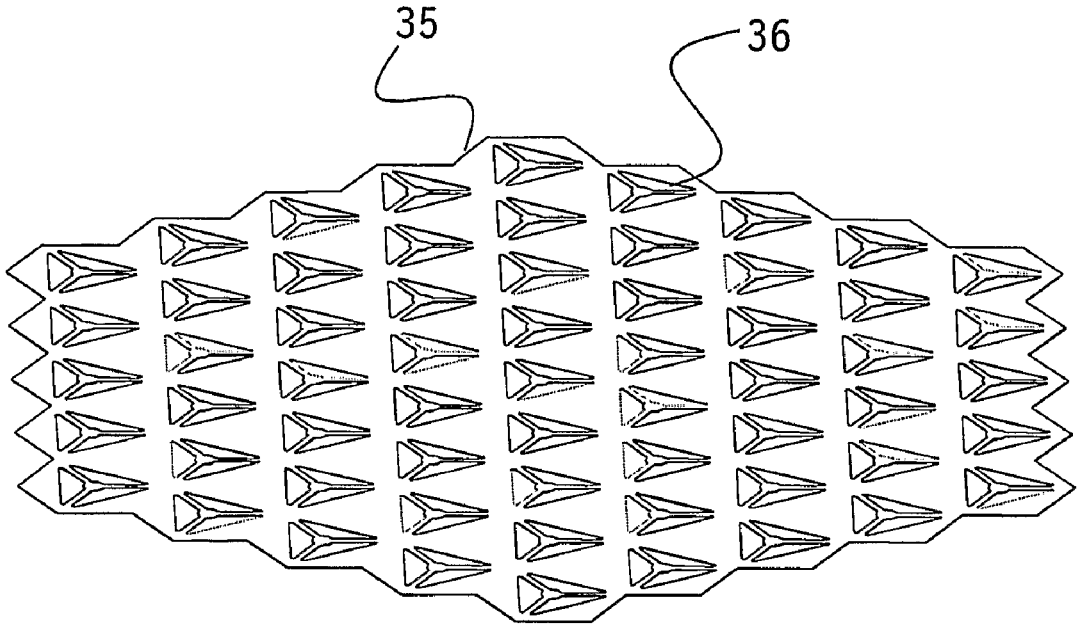
FIG. 4B shows a base element for a group of actuators according to the invention.
Figure 4A:
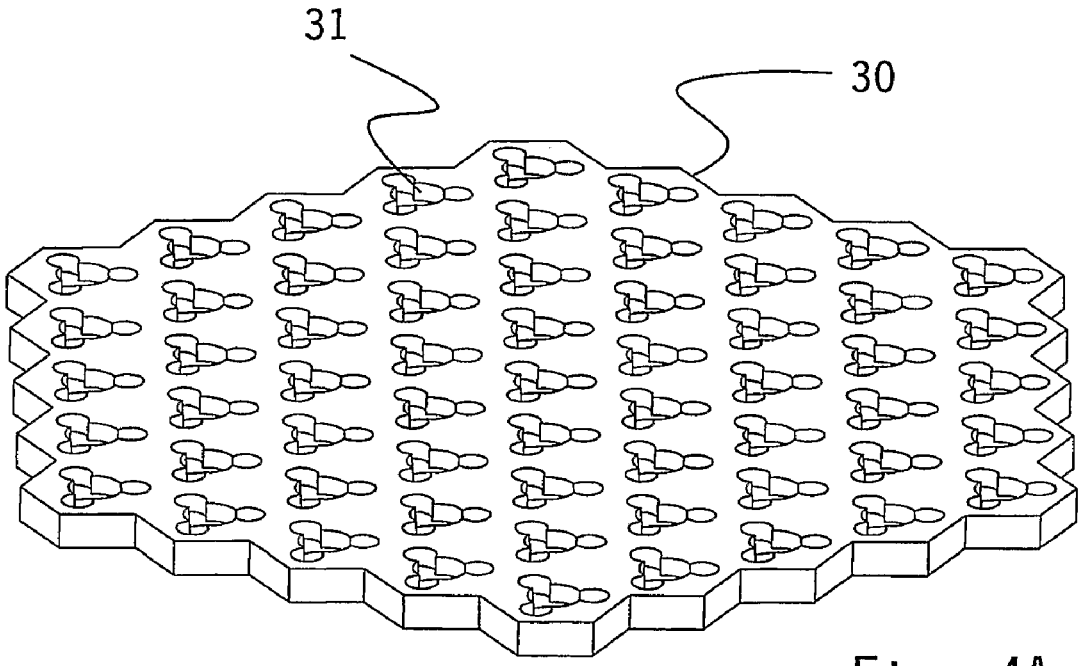
FIG. 4A shows a building element for a group of actuators according to the invention.

FIGS. 4A and 4B furthermore show a conductor core element 30 and a leaf spring element 35 that can be used for forming a group of actuators for forming a plane of actuators according to the invention. The conductor core element 30 consists of a multitude of conductor cores, such as the conductor core 31, whose shape appears to be recognisable upon comparison with the shape of the conductor core 8 in FIG. 1. The leaf spring element 35 similarly consists of a group of leaf springs 36, which likewise have a familiar shape. In combination with a multitude of bases 7, the electromagnets 2, the permanent magnets 1 and the drive cores 4 (shown in FIG. 3), a group of actuators according to the invention can readily be machine-made from the conductor core element 30 and the leaf spring element 35.

The group of the conductor cores 31 and the leaf springs 36 that is shown in FIGS. 4A and 4B is hexagonal in shape so as to provide a hexagonal group of actuators according to the invention. Those skilled in the art will appreciate, however, that said group may also have a different shape, if desired. Triangular, rectangular, pentagonal, septagonal, octagonal, concentric or other groups can be formed as well in a similar manner.

The embodiment of the invention as described and illustrated in detail in the foregoing must not be construed as being limitative to the invention, in which regard it is noted that the invention is only limited by be scope of the following claims.

The invention claimed is:

1. An actuator comprising:

spring means attached to a carrier in at least one point thereof for generating a spring force;

means for providing a magnetic field;

means for guiding the magnetic field so as to provide a magnetic flux loop, wherein a movable part of the spring means is movable relative to the means for providing the magnetic field; and a drive core attached to the movable part of the spring means, the drive core being incorporated in the flux loop for imparting the relative movement to the movable part, wherein:

the spring means is positioned outside the flux loop, such as to render the magnetic properties of the actuator independent of the material properties of the spring means; and the flux loop comprises a variable magnetic resistance formed by the drive core, the drive core being positioned such that, in use, a magnetic reluctance of the flux loop depends on a deflection of the spring means.

2. An actuator according to claim 1, wherein the magnetic force of the flux loop and the spring force of the spring means engage the drive core so as to provide the relative movement around a point of equilibrium.

3. An actuator according to claim 1 or 2, wherein the length of the flux loop can be changed under the influence of said relative movement.

4. An actuator according to claim 1, wherein at least one air gap is present in the flux loop between the drive core and the means for providing the magnetic field, the dimensions of the air gap being dependent on the position of the drive core relative to the means for providing the magnetic field.

5. An actuator according to claim 1, further comprising at least one air gap in the flux loop between the drive core and the means for providing the magnetic field, wherein the air gap functions to enable said relative movement, and wherein a dimension of the air gap is substantially independent of said relative movement.

6. An actuator according to claim 1, wherein the magnetic permeability in the flux loop is changeable under the influence of said relative movement.

7. An actuator according to claim 6, further comprising at least one air gap incorporated in the flux loop and a medium having a permeability different from that of air, wherein said medium is moveable into or out of the air gap under the influence of said relative movement so as to change the magnetic reluctance of the flux loop.

8. An actuator according to claim 1, wherein the means for providing the magnetic field comprises at least one permanent magnet.

9. An actuator according to claim 1, wherein the means for providing the magnetic field comprises at least one electromagnet.

10. An actuator according to claim 8, wherein the means for providing the magnetic field further comprises at least one electromagnet, and wherein the electromagnet is so positioned relative to the permanent magnet that, in use, the magnetic fields of the electromagnets and the permanent magnet jointly provide the magnetic flux in the flux loop.

11. An actuator according to claim 1, wherein the spring means comprises a material selected from a group comprising iron, nickel, titanium, cobalt, an alloy containing more than one of iron, nickel, titanium, and cobalt, and a plastic material.

12. An actuator according to claim 8, wherein the permanent magnet comprises a material selected from a group comprising NdFeB, SmCo and AlNiCo.

13. An actuator according to claim 1, wherein the spring means are attached to ends or edges of the carrier, and wherein the movable part of the spring means is located between said ends or edges.

14. An actuator according to claim 13, wherein the spring means has a rotationally symmetric configuration, and wherein the movable part of the spring means is joined to the edges by means of one or more of spokes formed in the spring means.

15. An actuator according to claim 14, wherein said movable part forms the centre of the rotationally symmetric spring means, and wherein the spokes extend radially towards said edge.

16. An actuator according to claim 1, wherein the spring means comprise at least one leaf spring.

17. An apparatus, comprising:

a plurality of the actuators according to claim 1; and means for individually controlling each of the actuators.

* * * * *